United States Patent [19]

McGee

[11] 4,356,854

[45] Nov. 2, 1982

[54] WORK POUCH

[76] Inventor: Ellis McGee, 1700 S. 6th St., Monroe, La. 71202

[21] Appl. No.: 289,227

[22] Filed: Aug. 3, 1981

Related U.S. Application Data

[63] Continuation of Ser. No. 929,903, Aug. 1, 1978, abandoned.

[51] Int. Cl.[3] ..... B65D 85/00

[52] U.S. Cl. ..... 150/12; 182/129; 248/97

[58] Field of Search ..... 150/1, 12; 248/97; 182/129

[56] References Cited

U.S. PATENT DOCUMENTS

| | | |
|---|---|---|
| 319,728 | 6/1885 | Kline . |
| 537,178 | 4/1895 | Blalock . |
| 656,946 | 8/1900 | Corduan . |
| 768,364 | 8/1904 | Hines . |
| 1,454,639 | 5/1923 | Haines . |
| 2,533,725 | 12/1950 | Eisenberg . |
| 2,597,756 | 5/1952 | Sitek . |
| 2,911,133 | 11/1959 | Ruggieri . |
| 3,252,613 | 5/1966 | McGrath . |
| 3,397,804 | 8/1968 | Davis . |
| 3,618,749 | 11/1971 | Vaccaro . |
| 3,642,240 | 2/1972 | Hershey . |
| 3,842,936 | 10/1974 | De Luca . |

FOREIGN PATENT DOCUMENTS 25334 of 1809 United Kingdom .

*Primary Examiner*—Donald F. Norton

*Attorney, Agent, or Firm*—Shapiro and Shapiro

[57] ABSTRACT

A work pouch has a central compartment configured to fit the top of a pedestal such as a stepladder and a depending skirt which hangs over the top portion of the pedestal and has a plurality of side compartments. The work pouch provides storage of tools, equipment and supplies convenient to a person on a stepladder or scaffold.

9 Claims, 2 Drawing Figures

WORK POUCH

This is a continuation application of Ser. No. 929,903, filed Aug. 1, 1978, now abandoned.

BACKGROUND OF THE INVENTION

This invention relates generally to portable article carriers, and more particularly to an article carrier of the pouch type which fits the top of a stepladder or other pedestal to hold tools, equipment and supplies.

Different types of devices are known in the prior art to hold articles used by a workman on a stepladder. Commonly, hooks, brackets, clamps, or other attachment devices have been required to support implements or article-receiving containers on a ladder.

The prior art suffers from various disadvantages, including limitations on the type of equipment or articles that can be supported, rigidity and bulk of the article-receiving containers, inconvenience in handling and securing the containers to the ladder, and the requirement that attachment and support devices be rather permanently affixed to the ladder.

SUMMARY OF THE INVENTION

Accordingly, it is an object of the invention to provide a portable and lightweight article carrier which may be easily positioned on and removed from the top of a pedestal, such as a stepladder, and which may hold a wide variety of work tools, equipment and supplies.

Another object of the invention is to provide an article carrier of the foregoing type that is made of flexible, inexpensive materials.

A further object of the invention is to provide an article carrier of the foregoing type which may also be used on a scaffolding or with other supports.

In accordance with a preferred embodiment of the invention, an article carrier or work pouch of a flexible material has a center pocket shaped to fit the top of a stepladder and a skirt depending from the center pocket and adapted to hang beside the upper portion of the ladder. The skirt has a number of pockets, which, like the center pocket, receive and hold various articles, such as work tools, equipment and supplies. The weight of the articles in the pockets securely positions the work pouch on the ladder. A carrying strap attached to opposite sides of the center pocket permits the work pouch to be easily removed from the ladder, carried about, and conveniently hung. The work pouch may also be supported on pedestals other than stepladders, such as a stand on a scaffolding.

The foregoing and other objects and advantages of the invention will be apparent from the following detailed description of preferred and exemplary embodiments of the invention taken in conjunction with the accompanying drawings.

DETAILED DESCRIPTION OF THE PREFERRED EMBODIMENTS

Figure 1:
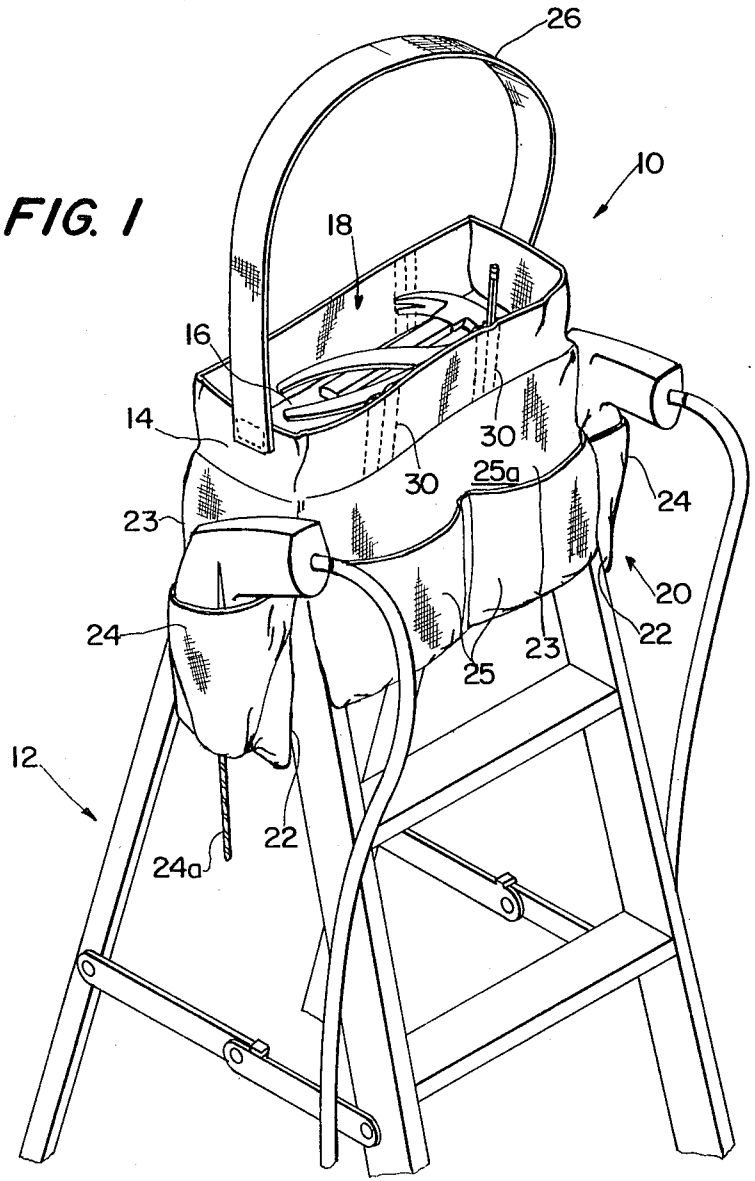
FIG. 1 is a perspective view showing an article carrier of the invention disposed on top of a stepladder.

In FIG. 1 of the drawings, an article carrier or work pouch 10 of the invention is shown positioned on top of a conventional stepladder 12. Preferably, the work pouch 10 has a sidewall 14 connected at its lower edge to a bottom surface or base 16 which rests on top of the stepladder 12. The sidewall 14 has sufficient body to extend substantially vertically when the work pouch 10 is disposed in the position shown in FIG. 1. Sidewall 14 and bottom 16 form a central pocket or compartment 18 within which various articles such as tools, equipment and work supplies may be stored, ready for use by a workman on the stepladder 12.

A skirt 20, which may comprise pairs of oppositely disposed flaps 22 and 23, hangs from the sidewall 14 around the upper portion of the stepladder 12. A number of side pockets or compartments 24 and 25 are attached to the flaps 22 and 23. The shapes and sizes of the side pockets 24 and 25 may be suitably chosen to hold work tools and equipment, such as hammers, drills, screwdrivers, ratchets, nails, bolts, etc. The bottom of selected side pockets, such as pockets 24, may be provided with one or more holes through which a portion of a tool, such as the bit **24*a* of a drill, may extend. If desired, cover flaps (not shown) for selected pockets may be provided, as at region 25*a* above pockets 25**. Additionally, a number of loops (not shown) may be attached to the flaps in place of the side pockets or in addition to the side pockets, to hold hand tools such as screwdrivers, drills, hammers, etc.

A strap 26 is attached at its ends to the sidewall 14 to provide a convenient carrying means for the work pouch 10. The strap may also be used to hang the work pouch from a suitable support, such as part of a scaffolding, as shown at the left side of FIG. 2.

Figure 2:
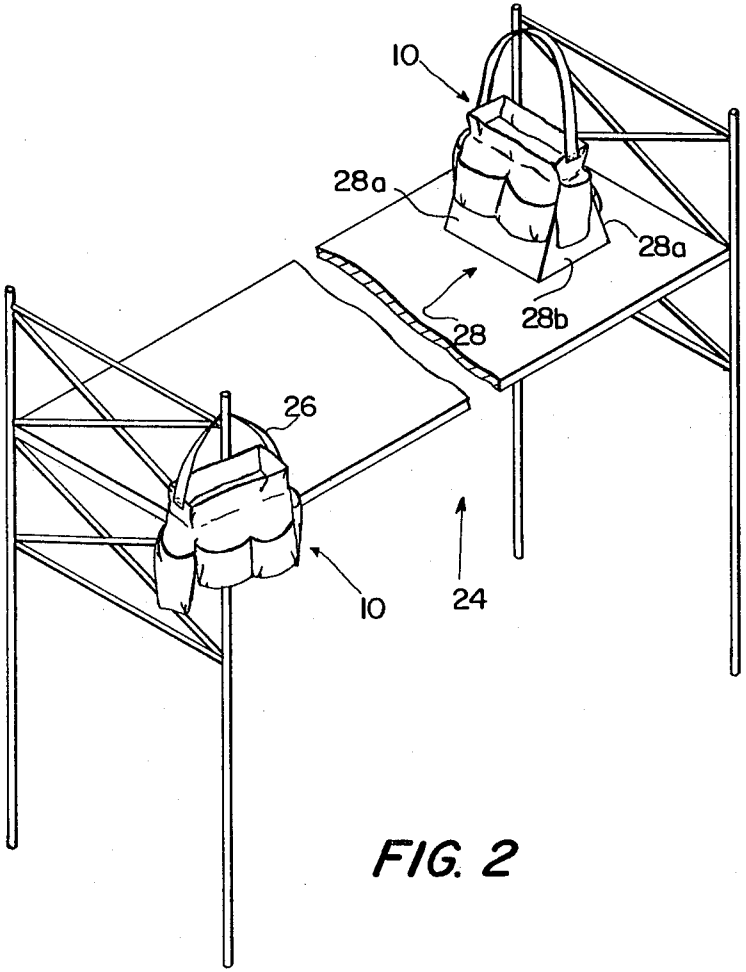
FIG. 2 is a perspective view showing article carriers of the invention fitted over a pedestal on a scaffolding and hung from the scaffolding.

The work pouch 10 is particularly configured and adapted to fit over the top of a conventional stepladder 12. When the work pouch is supported in this manner, the articles in the pockets, particularly the side pockets 24 and 25, provide weight which stabilizes the pouch on the ladder. While a stepladder is the preferred pedestal for the invention, other types of pedestals may also be used. For example, as shown in FIG. 2, the work pouch 10 may be positioned over a support stand or pedestal 28 on a scaffolding 29. Stand 28 preferably has an external configuration resembling the top portion of a conventional stepladder and may comprise a pair of said members **28*a*, a pair of end members 28*b*, and a top member (not shown). The side members 28*a* may be inclined like the sides of the stepladder shown in FIG. 1. The support stand 28** may be fabricated from any suitable rigid material and may be made collapsible.

The work pouch 10 may be made of a suitable flexible material, such as heavy-duty cloth (e.g., duck cloth), vinyl, leather, or the like. By virtue of its flexibility, the work pouch conforms readily to the shape of the top of a stepladder, accepts tools and equipment of different sizes and shapes, and collapses for compact storage when not in use. The side pockets 24 and 25 can be suitably configured and attached to the skirt flaps 22 and 23, such as by sewing or the like. Additionally, smaller pockets 30 may be provided in the sidewall 14, as by parallel stitching, for tools such as screwdrivers, pencils, etc. Although the skirt 20 is shown comprising separate flaps, such as 22 and 23, a continuous tubular skirt may also be employed, forming a receptacle for the upper portion of the ladder 12 or other pedestal.

The work pouch of the invention provides an inexpensive, lightweight, portable means for keeping together, in one convenient place, all of the necessary tools, equipment and supplies that a workman may require when working from a stepladder. The use of the work pouch eliminates the need to keep tools and work parts in the pockets of clothing, and saves trips up and down a ladder. As an example only, a drapery installer can conveniently place all of the necessary tools and parts required for the installation of drapery hardware in a work pouch of the invention, which he can carry from window to window, together with or removed from a stepladder, and in which he can store all of the tools and parts when not in use.

While preferred embodiments of the invention have been shown and described, it will be apparent to those skilled in the art that changes can be made in these embodiments without departing from the principles and spirit of the invention, the scope of which is defined in the appended claims.

The invention claimed is:

1. An article carrier adapted to be supported on a pedestal, comprising:

a central compartment having a base adapted to rest on the top of the pedestal and an upstanding peripheral sidewall;

a flexible skirt depending from the central compartment and adapted to hang beside the upper portion of the pedestal, the skirt having pocket means on opposite sides thereof for receiving articles, the pocket means including a pair of open-topped pockets on opposite sides of the skirt respectively, said pockets each being configured to receive an electric drill; and a handle in the form of a strap attached to opposite sides of said sidewall.

2. An article carrier in accordance with claim 1, wherein the skirt comprises a plurality of flaps, each having pocket means.

3. An article carrier in accordance with claim 1, wherein the central compartment is formed of flexible material.

4. A combination in accordance with claim 1, wherein said skirt is tubular.

5. In combination with a pedestal having a top member and side members, an article carrier supported on the pedestal, the carrier comprising:

a central compartment having a base that rests on the top member of the pedestal and an upstanding peripheral sidewall;

a flexible skirt depending from the central compartment and hanging beside the upper portion of the pedestal, the skirt having pocket means on opposite sides thereof for receiving articles, the pocket means including a pair of open-topped pockets on opposite sides of the skirt respectively, said pockets each being configured to receive an electric drill; and a handle in the form of a strap attached to opposite sides of said sidewall.

6. A combination in accordance with claim 5, wherein the skirt comprises a plurality of flaps, each having pocket means.

7. A combination in accordance with claim 5, wherein the pedestal is a stepladder.

8. A combination in accordance with claim 5, wherein the pedestal is a stand having inclined side members.

9. A combination in accordance with claim 5, wherein the central compartment is formed of flexible material.

* * * * *